US007124902B1

(12) United States Patent
Chen

(10) Patent No.: US 7,124,902 B1
(45) Date of Patent: Oct. 24, 2006

(54) RACK WITH LINEAR GUIDE

(75) Inventor: Hsin-Yueh Chen, Chang Hua Hsien (TW)

(73) Assignee: I Jang Industrial Co.,Ltd., Chang Hua Hsien (TW)

( * ) Notice: Subject to any disclaimer, the term of this patent is extended or adjusted under 35 U.S.C. 154(b) by 40 days.

(21) Appl. No.: 10/948,482

(22) Filed: Sep. 24, 2004

(51) Int. Cl.
*A47F 5/00* (2006.01)

(52) U.S. Cl. ..... 211/162; 211/162; 211/151; 211/46

(58) Field of Classification Search ..... 211/162, 211/151, 46; 312/198, 199, 200, 201
See application file for complete search history.

(56) References Cited

U.S. PATENT DOCUMENTS 1,601,988 A * 10/1926 Vanderveld ..... 312/133
2,166,704 A * 7/1939 Foulkes ..... 312/199
2,707,442 A * 5/1955 Ingold ..... 312/199
2,812,069 A * 11/1957 Trammell ..... 211/162
4,417,524 A * 11/1983 Quinn et al. ..... 105/101
4,624,510 A * 11/1986 Jedziniak ..... 312/223.3
4,738,369 A * 4/1988 Desjardins ..... 211/113
4,913,298 A * 4/1990 Compagnucci ..... 211/162
5,938,047 A * 8/1999 Ellis et al. ..... 211/1.57
2004/0256339 A1* 12/2004 Welsch et al. ..... 211/162

* cited by examiner

*Primary Examiner*—Richard E. Chilcot, Jr.
*Assistant Examiner*—Lindsay M. Maguire
(74) *Attorney, Agent, or Firm*—Egbert Law Offices

(57) ABSTRACT

A sliding rack apparatus having a rack body having supported on a slide rest and movable along a pair of slide tracks. The slide rest has a pair of rollers with a rut therebetween. The slide tracks have a convex edge in a center thereof so as to extend in the rut between the rollers. A braking device has a T-shaped plate with a rim that is pivotable between a first portion engaging the convex edge and a second position free of the convex edge.

3 Claims, 6 Drawing Sheets

RACK WITH LINEAR GUIDE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rack, and more particularly to a rack with a linear guide allows for linear movement.

BACKGROUND OF THE INVENTION

Generally, a rack is to be fixed at a certain place to hold and store articles. However, in some special locations, such as supermarkets and storehouses, the size and number of racks are too big and any relocation and sorting of articles require large amount of time and labor, resulting in waste of time and labor force as well as increasing cost. Consequently, this kind of fixed rack is not desirable.

Therefore, an ideal and practical rack is called for to solve the above problems.

In light of this, this invention intends to propose a new rack structure.

BRIEF SUMMARY OF THE INVENTION

1. This invention proposes a new rack which can move linearly on the sliding rail.

2. The rack is posed on the sliding rails by its slide rest. The length of the sliding rails can be decided according to the need and allows the rack to move linearly within it. This is more convenient and saves time and labor force as well.

3. With the convex sliding rail and compartmental rollers, the rack can move smoothly with a linear guide.

4. The connection of the rails allows easy extension without tools.

5. The braking device can control the rack to move or stop easily.

6. The cushion at the end of the slide rest can reduce the shock and noise on impact the end of the rail.

The above is a detailed description of the technical features of this invention. Any adjustment and revision of this invention should be subject to the invention and within the scope prescribed by the patent.

DETAILED DESCRIPTION OF THE INVENTION

Figure 1:
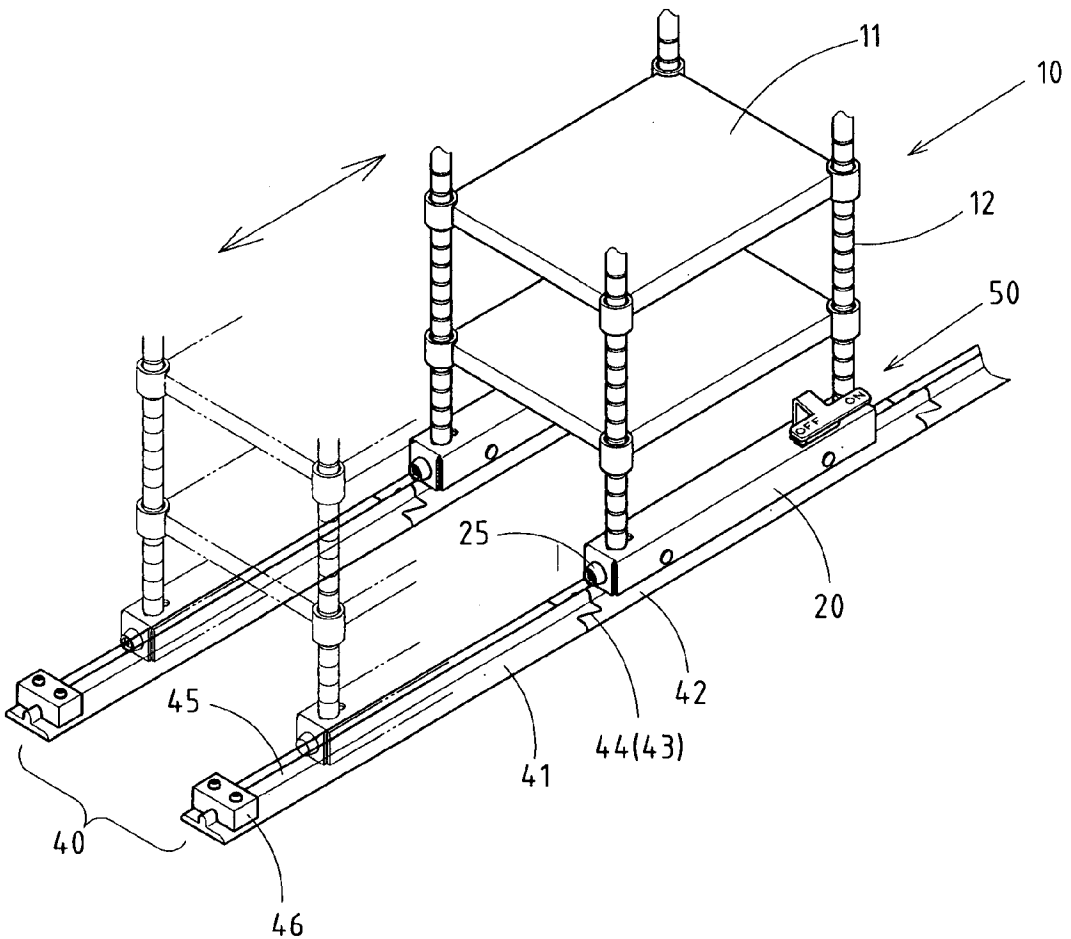
FIG. 1 shows a perspective view of the preferred embodiment of the present invention.
Figure 2:
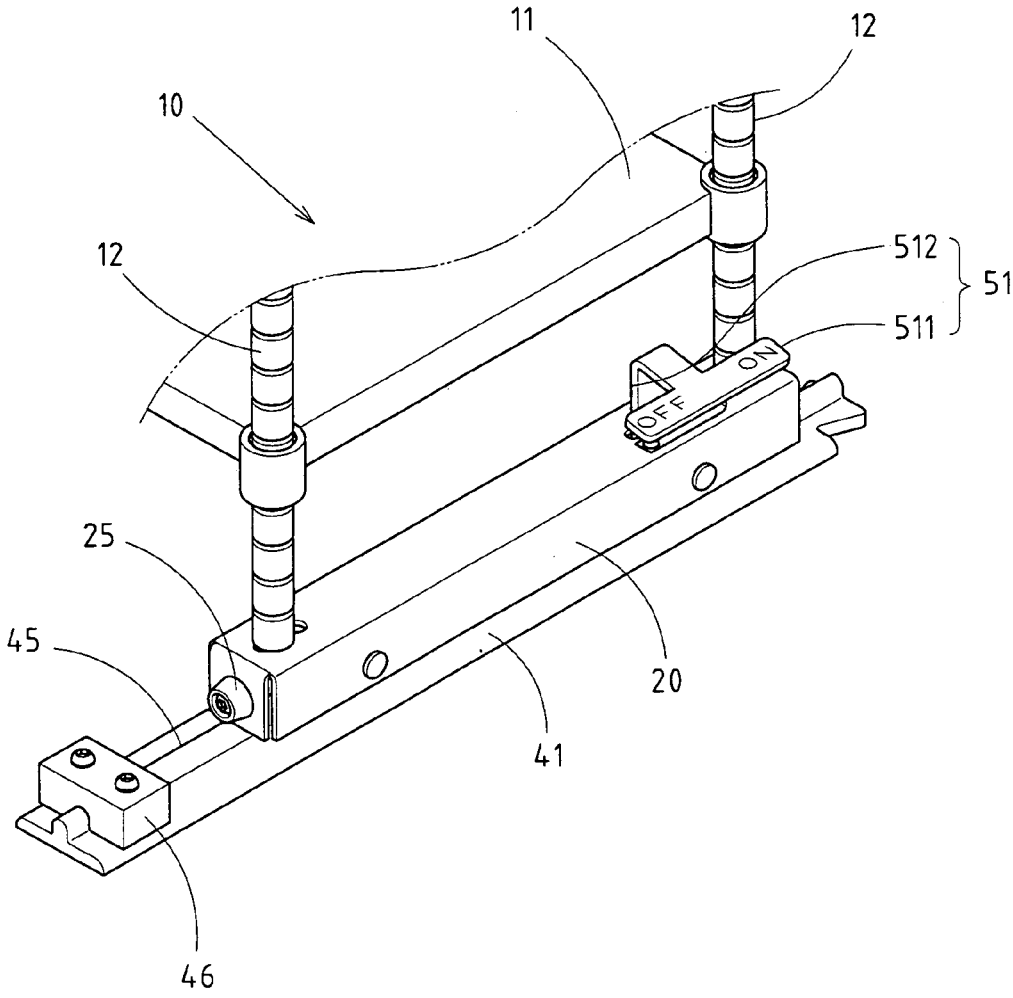
FIG. 2 shows a perspective view of the partial structure of the invention.
Figure 3:
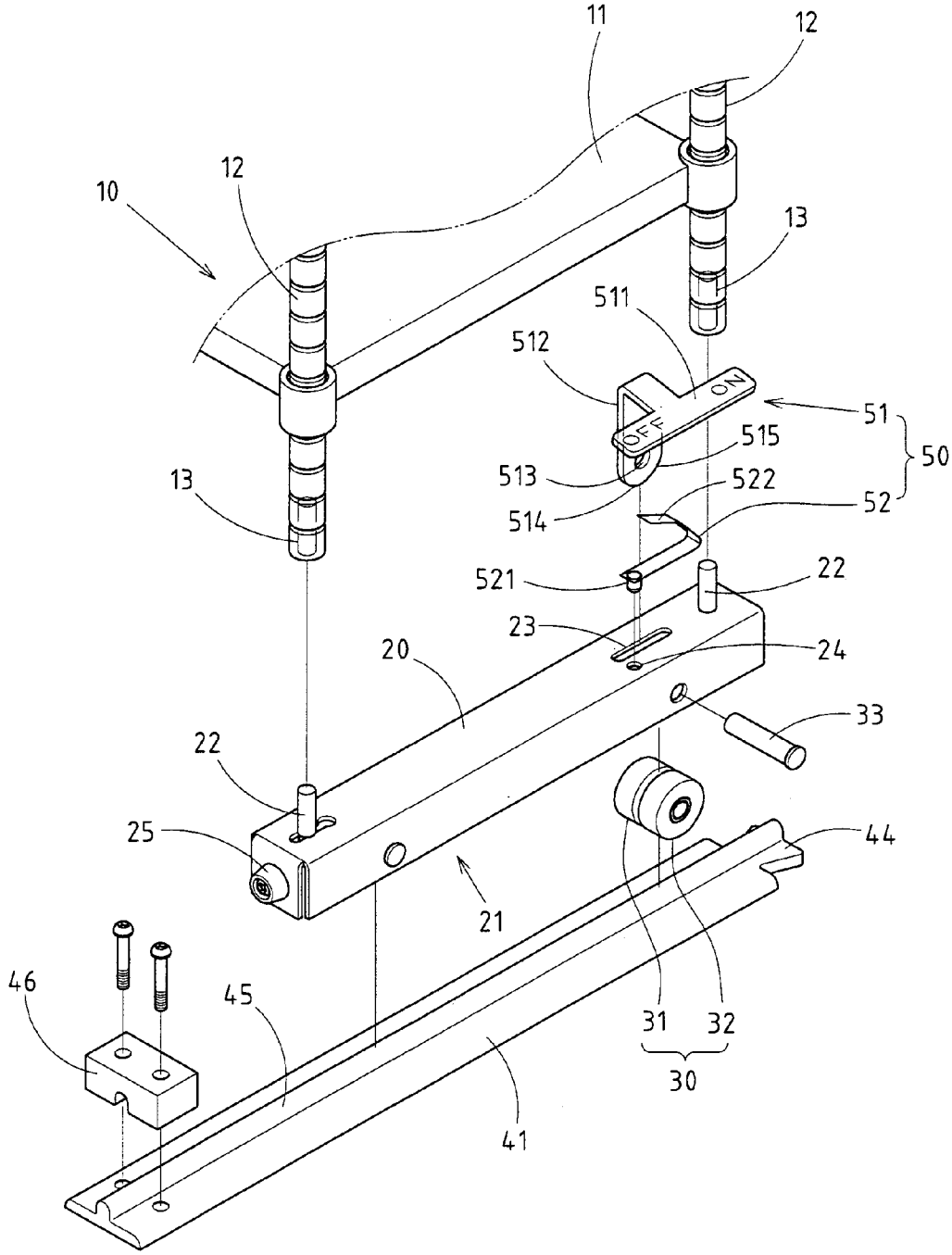
FIG. 3 shows an exploded perspective view of the partial structure of the invention.
Figure 4:
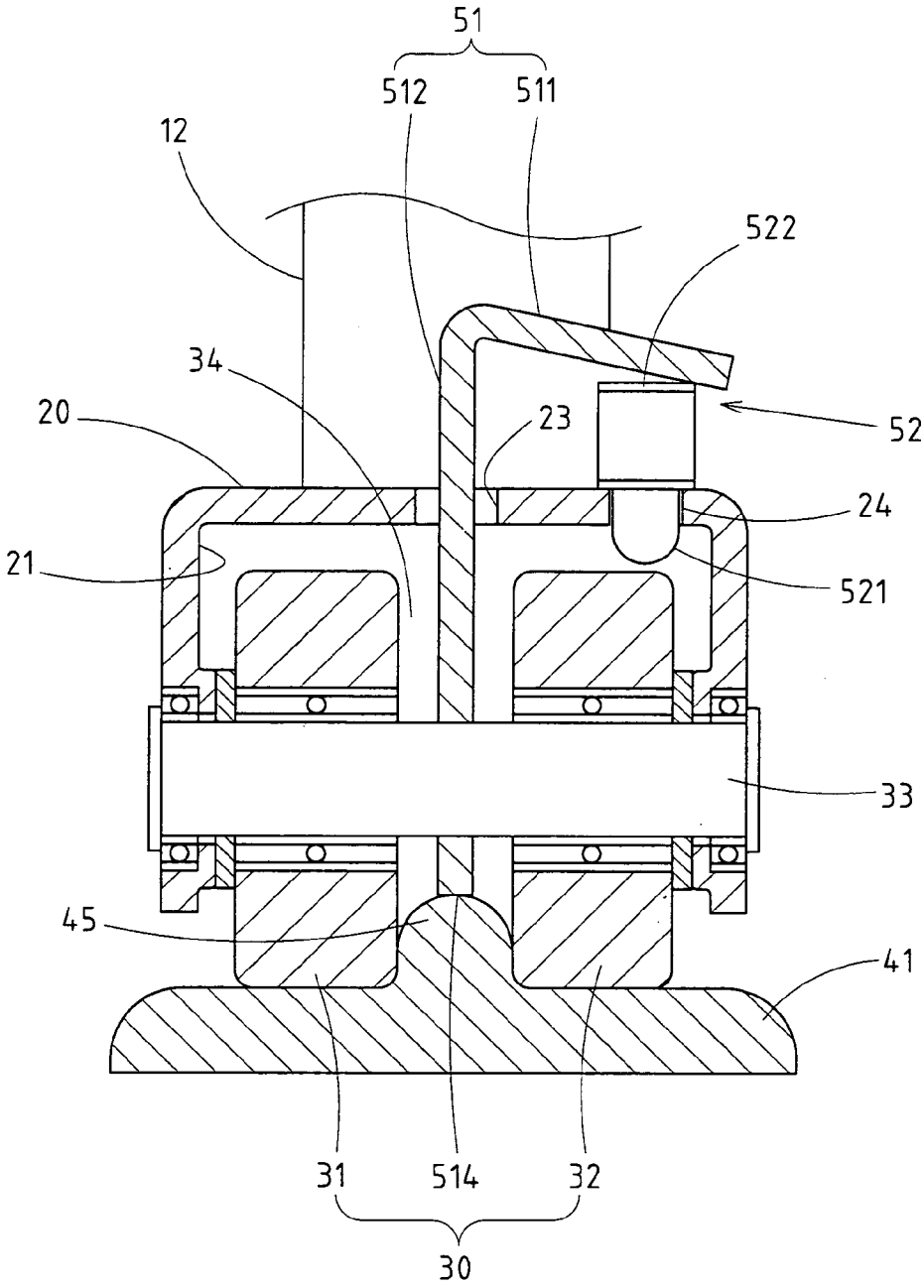
FIG. 4 shows a partial vertical section view of the slide rest.

As shown in FIGS. 1–4, there is a rack with linear guide embodied in the present invention.

The invention includes a rack body 10, composed of several shelves 11 and stings 12 of several directions (in this case, there are four directions). There are pre-set plugholes 13 at the end of each sting 12.

There are also slide rests 20, divided into two groups and set at the ends of the two stings 12 of the rack body 10. This □ type slide rest is made of metal plate and has a rut 21. At both ends of the slide rest 20 there are standing columns 22 to fit into the pre-set plugholes 13 at the end of each sting 12 of the rack body 21.

The invention further includes a compartmental roller 30, fixed at the both ends of the rut 21 of the slide rest 20 by horizontal axis hitch 33. This compartmental roller 30 can be divided into left roller 31 and right roller 32, between which there is a compartmental rut 34. The bottom edges of the left and right rollers 3132 are both bulging from the slide rest 20.

There are two parallel sliding tracks 40, each is composed of several independent sliding rails which are connected and fixed (via bolts) on the floor at the position of the rack 10 to bear the two slide rests 20. The rails 41 42 can be connected by flange 44 and concave rim 43. The section of the rail is convex, in the middle of which there is a convex edge 45 (see FIG. 4 for details). This convex edge can fit into the compartmental rut 33 between the left and right rollers 31 32 and form linear guide.

The invention also has a blocker 46, fixed at the end of the rail 41 to stop slide rest 20 and keep the rack 10 on the rail 40.

Figure 5:
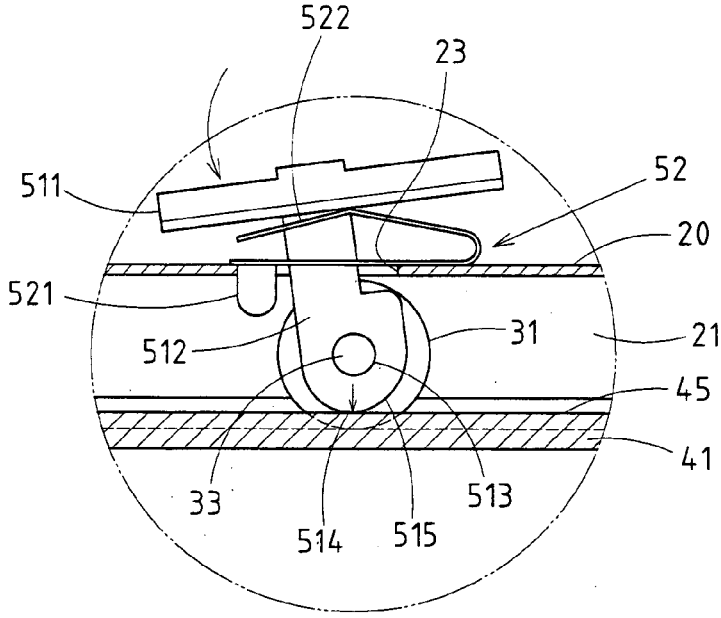
FIGS. 5–6 show close-up elevation views of the moving state of the braking component.
Figure 6:
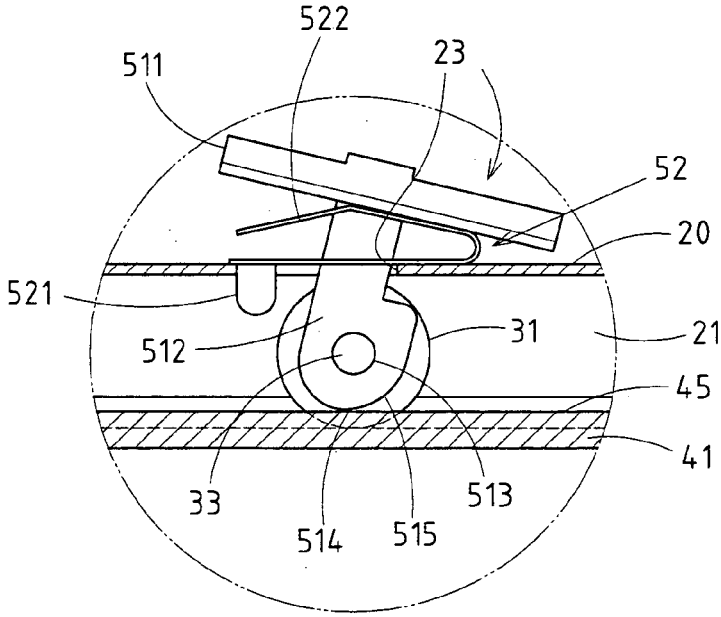
Figure 7:
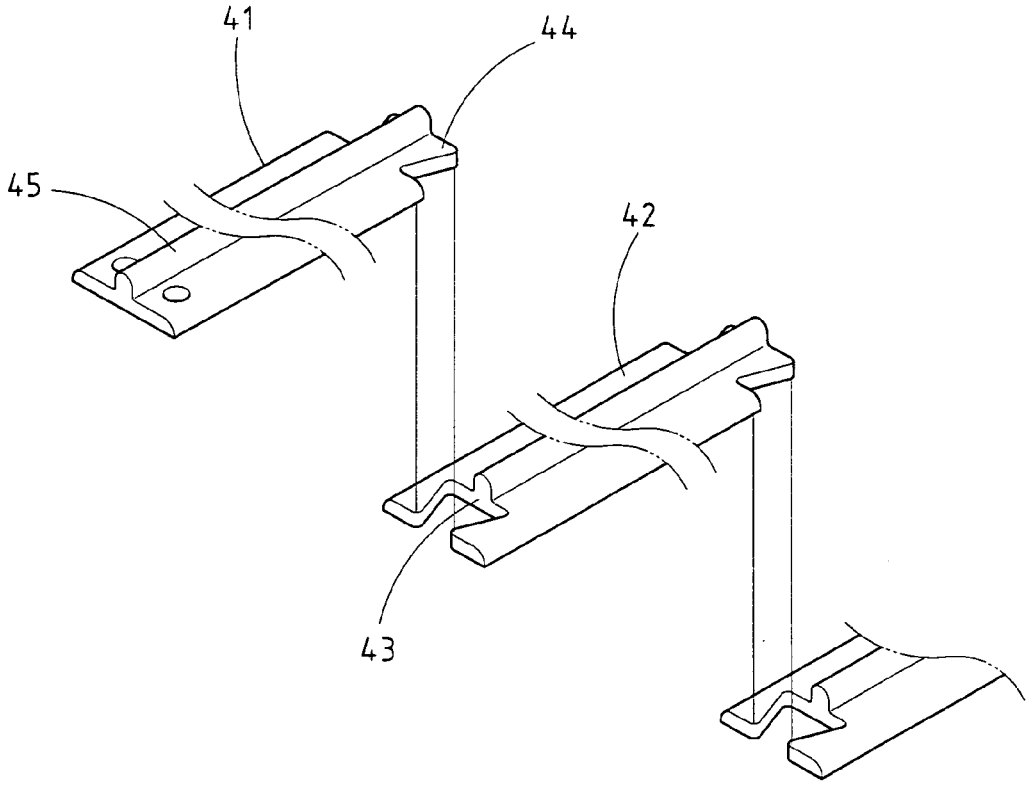
FIG. 7 shows an exploded perspective view of the rail.

Also, there is a braking device 50, installed at the connecting part between the slide rest 20 and the compartmental roller 30 and composed of a T type plate 51 and an elastic device 52. At the end of the T type plate 51 there is a horizontal board 511 protruding from the slide rest 20 to serve as controlling button. The vertical board 512 at the bottom of the T type plate 51 passes through an opening 23 at the slide rest 20. A through-hole 513 at the bottom of the vertical board 512 can catch the middle part of the axis hitch 33 between the left and right rollers 31 32. The bottom rim 514 of the vertical board 512 can catch the convex rim 45 of the sliding rail 41 when the vertical board 513 is at the first angle and brake the rack 10 (see FIG. 5). There is a contracting rim 515 at the bottom rim 514 of the vertical board 512, which can release the convex rim 45 when the vertical board 512 is at the second angle (see FIG. 6) and release the rack 10 accordingly. The elastic device 52 is positioned between the horizontal board 511 of the T type plate 51 and the slide rest 20, by which the T type plate can return home. The elastic device can be a U type elastic plate, at the bottom of which there is a bulging column 521, which can fit into the plughole 24 of the slide rest 20. The top end of the U type elastic plate supports the horizontal board 511 of the T type board 51.

The horizontal end of the slide rest 20 can have a cushion 25 (such as rubber cushion) to reduce the shock and noise generated by the impact on the blocker 46 at the end of the rail. The rack revealed by this invention can be put on the sliding rails by the slide rest 20 at the bottom and move linearly at pre-set length. With the braking device 50, the rack 10 can move and stop at any place on the rails.

I claim:

1. A rack apparatus comprising:

a rack body having a plurality of stings extending downwardly therefrom, each of said plurality of stings having a plughole at a bottom end thereof;

a slide rest having a generally rectangular shape, said slide rest having a pair of spaced columns extending upwardly therefrom, the columns being received by the plugholes;

a compartmental roller rotatably mounted to said slide rest, said compartmental roller having a pair of rollers with a rut therebetween, said pair of rollers having a portion extending downwardly beyond a bottom of said slide rest, said compartmental roller having an axle supporting said pair of rollers and extending through a through hole in said slide rest;

a pair of sliding tracks arranged in parallel relation to each other, each of said pair of slide tracks supporting said slide rest and said compartmental roller thereon, each of said pair of slide tracks comprised of a plurality of track segments joined in end-to-end relation, said pair of sliding tracks being affixed by bolts to an underlying surface and supporting said rack body thereon, each of said plurality of track segments connected together by a tongue-and-groove connection, each of said pair of sliding tracks being convex with a convex edge in a center thereof, said rut of said compartmental roller receiving said convex edge therebetween;

a blocker affixed at an end of at least one of said pair of sliding tracks so as to stop a movement of said rack body thereon; and a braking mechanism installed so as to be cooperative between said slide rest and said compartmental roller, said braking mechanism comprising a T-shaped plate and an elastic member, said T-shaped plate having a horizontal board positioned outwardly of said slide rest so as to serve as a control button for said braking mechanism, said T-shaped plate having a vertical portion extending through an opening in said slide rest, said axle extending through a through-hole formed in said vertical portion, said vertical portion positioned between said pair of rollers, said vertical portion having a bottom rim having a surface suitable for contacting said convex rim of the sliding rail when said vertical portion is at a first angle, said surface of said bottom rim releasing from said convex rim when said vertical portion is at a second angle, said elastic member positioned between said horizontal board and said slide rest so as to resiliently urge said T-shaped plate to a home position.

2. The rack apparatus of claim 1, said elastic member being a generally U-shaped plate, said U-shaped plate having a bulging column at a bottom thereof, said bulging column received by a hole formed on said slide rest, said U-shaped plate having a top surface support said horizontal board.

3. The rack apparatus of claim 1, further comprising:

a cushion affixed to an end of said slide rest so as to contact said compartmental roller when said slide rest moves to an end of said pair of slide tracks.

* * * * *